US008104173B2

(12) United States Patent
Heacox et al.

(10) Patent No.: US 8,104,173 B2
(45) Date of Patent: Jan. 31, 2012

(54) METHOD FOR MANUFACTURING A SERIES OF ELECTRIC TERMINALS

(75) Inventors: Mark J. Heacox, Aurora, OH (US); Scott Shemitz, Middlefield, OH (US); Xuefu Xu, KunShan (CN); David A. Beck, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 925 days.

(21) Appl. No.: 12/082,011

(22) Filed: Apr. 8, 2008

(65) Prior Publication Data

US 2009/0249609 A1 Oct. 8, 2009

(51) Int. Cl.
*H01R 43/16* (2006.01)

(52) U.S. Cl. ..... 29/874; 29/825

(58) Field of Classification Search ..... 29/874–885; 174/68.1–68.3, 250–268; 439/135–160, 439/217–224, 296–381, 869–873, 877–893
See application file for complete search history.

(56) References Cited

U.S. PATENT DOCUMENTS

| | | | | | |
|---|---|---|---|---|---|
| 3,668,615 | A * | 6/1972 | Bury | 439/695 |
| 3,702,104 | A * | 11/1972 | Brubaker | 29/874 |
| 3,828,706 | A * | 8/1974 | Scott | 29/879 |
| 4,453,799 | A * | 6/1984 | Inoue | 439/861 |
| 4,472,017 | A * | 9/1984 | Sian | 439/872 |
| 4,564,259 | A * | 1/1986 | Vandame | 439/852 |
| 4,696,530 | A * | 9/1987 | Vandame | 439/266 |
| 4,927,788 | A * | 5/1990 | Nakashima et al. | 439/887 |
| 5,188,546 | A * | 2/1993 | Ballard et al. | 439/885 |
| 5,235,743 | A * | 8/1993 | Endo et al. | 29/885 |
| 5,427,552 | A * | 6/1995 | Zielinski et al. | 439/845 |
| 5,480,320 | A * | 1/1996 | Saimoto | 439/852 |
| 5,536,186 | A | 7/1996 | Watanabe | |
| 5,540,603 | A * | 7/1996 | Fujiwara | 439/851 |
| 5,551,150 | A * | 9/1996 | Zielinski et al. | 29/882 |
| 5,577,928 | A * | 11/1996 | Duclos | 439/290 |
| 5,622,515 | A * | 4/1997 | Hotea et al. | 439/398 |
| 5,685,746 | A * | 11/1997 | Maejima | 439/845 |
| 5,769,673 | A * | 6/1998 | Ohta et al. | 439/852 |
| 5,899,775 | A * | 5/1999 | Davis et al. | 439/748 |
| 5,924,900 | A * | 7/1999 | Davis et al. | 439/748 |
| 5,980,336 | A * | 11/1999 | Hall et al. | 439/843 |
| 6,019,646 | A * | 2/2000 | Okamura et al. | 439/852 |
| 6,042,433 | A * | 3/2000 | Chen | 439/852 |
| 6,062,918 | A * | 5/2000 | Myer et al. | 439/839 |
| 6,095,873 | A * | 8/2000 | Muramatsu et al. | 439/852 |
| 6,227,915 | B1 * | 5/2001 | Sakatani et al. | 439/852 |
| 6,352,453 | B2 * | 3/2002 | Saitoh | 439/843 |
| 6,386,928 | B2 * | 5/2002 | Kitamura | 439/852 |
| 6,447,345 | B2 * | 9/2002 | Sato et al. | 439/852 |
| 6,450,843 | B1 * | 9/2002 | Heimuller | 439/852 |
| 6,453,552 | B1 | 9/2002 | Chavez, Jr. et al. | |

(Continued)

*Primary Examiner* — Derris Banks
*Assistant Examiner* — Kaying Kue
(74) *Attorney, Agent, or Firm* — Thomas N. Twomey

(57) ABSTRACT

A series of electric terminals in which each member of the series has an identical receptacle portion at one end and a unique cable attachment portion at an opposite end is manufactured by forming a generic strip of partially formed terminals having a receptacle portion at one end in a first progressive die forming operation for all members of the series of electric terminals. Strips of completely formed electric terminals of particular members of the series of electric terminals are then completed in respective unique die progressive die forming operations using the generic strip of partially formed terminals. A modular die may be used for forming the strips of completely formed electric terminals from the intermediate generic the strip of partially formed terminals.

4 Claims, 2 Drawing Sheets

U.S. PATENT DOCUMENTS

| | | | | |
|---|---|---|---|---|
| 6,505,402 | B2 | 1/2003 | Moriwake et al. | |
| 6,506,063 | B1 | 1/2003 | Moriwake et al. | |
| 6,547,608 | B2 * | 4/2003 | Sato et al. | 439/852 |
| 6,679,738 | B2 * | 1/2004 | Nimura | 439/852 |
| 6,851,989 | B2 * | 2/2005 | Maeda | 439/852 |
| 6,964,095 | B2 * | 11/2005 | Jacques | 29/874 |
| 7,086,873 | B2 | 8/2006 | Nose et al. | |
| 7,101,233 | B2 * | 9/2006 | Maeda | 439/852 |
| 7,207,809 | B2 | 4/2007 | Sasaki et al. | |
| 7,252,564 | B1 * | 8/2007 | Morello et al. | 439/877 |
| 7,598,455 | B2 * | 10/2009 | Gump et al. | 174/75 C |
| 7,670,198 | B2 * | 3/2010 | Shimizu | 439/852 |
| 7,856,712 | B2 * | 12/2010 | Busies et al. | 29/882 |
| 2002/0192988 | A1 | 12/2002 | Droesbeke et al. | |
| 2004/0115971 | A1 | 6/2004 | Nose et al. | |
| 2005/0208795 | A1 | 9/2005 | Huang | |
| 2008/0214049 | A1 * | 9/2008 | Gump et al. | 439/607 |

* cited by examiner

METHOD FOR MANUFACTURING A SERIES OF ELECTRIC TERMINALS

BACKGROUND OF THE INVENTION

This invention relates generally to a method of manufacturing a series of electric terminals.

Electric terminals generally comprise a contact portion at one end and an attachment portion at an opposite end. The contact portion is adapted for a temporary connection to a mating contact portion of another electric terminal while the attachment portion is adapted for permanent attachment to another electric element such as an electric cable or the like.

Thus a series of electric terminals may have identical contact portions at one end while having different attachment portions at an opposite end that are adapted for permanent attachment to different electric elements such as several different electric cables of various sizes and/or types.

In the past each member in a series of electric terminals for electric cables was manufactured with an identical contact portion at one end and a unique attachment portion at the other end for permanent attachment to a particular size or small size range of electric cables. Each member in turn required a unique set of progressive forming dies. For instance a typical female electric connector for an electric cable requires a set of progressive forming dies comprising forty to fifty individual dies.

This known method is satisfactory for manufacturing electric terminals that perform well. However, the known method is expensive from a manufacturing standpoint because of the requirement for several sets of unique progressive forming dies and the need for a large inventory storing each of the several members of the series of electric terminals. The expense is particularly notable when one or more member of the series has a relatively low volume of use.

SUMMARY OF THE INVENTION

This invention provides a method of manufacturing a series of electric terminals for electric cables that takes advantage of the fact that each member in the series of electric terminals has an identical contact portion at one end.

Basically the series of electric terminals is manufactured in a two stage manufacturing process where all members of the series have an identical contact portion formed in a primary operation in a common set of progressive forming dies. Each member of the series then has their unique attachment portions formed in a secondary operation in a unique set of progressive forming dies thereby reducing capital expenditures and inventory costs.

Savings in capital expenditures and inventory costs are particularly advantageous in electric terminals that have a contact portion that is progressively formed in a relatively large number of steps in comparison to a relatively few number of steps needed to form the attachment portion. This advantage increases with the complexity of the contact portion, and can result in considerable savings, particularly in the case of female terminals that often have complex contact portions.

DETAILED DESCRIPTION OF THE PREFERRED EMBODIMENTS

Figure 1:
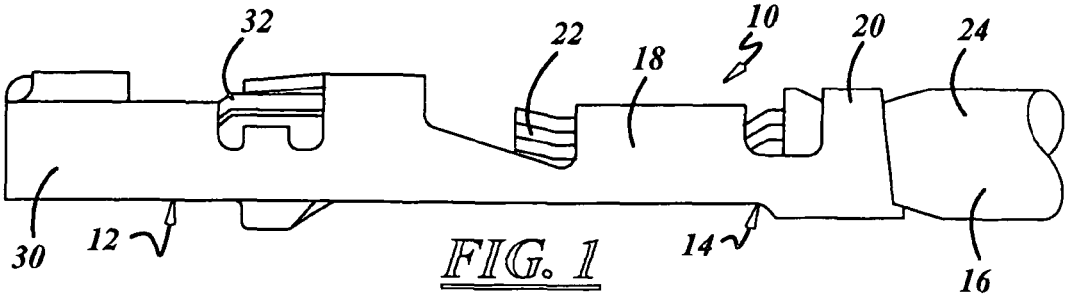
FIG. 1 is a side view of a typical female electric terminal that can be manufactured in a series in accordance with the invention.
Figure 2:
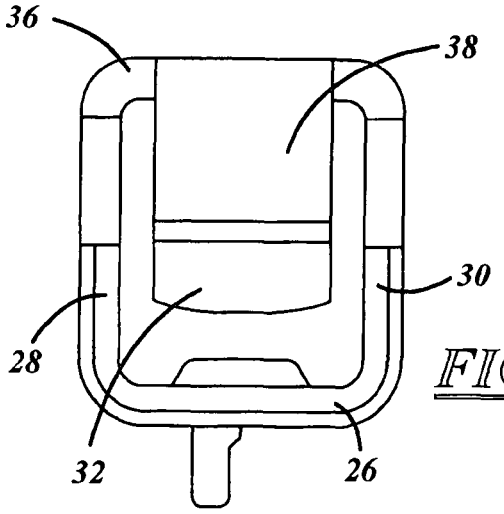
FIG. 2 is a front view of the electric terminal shown in FIG. 1.
Figure 3:
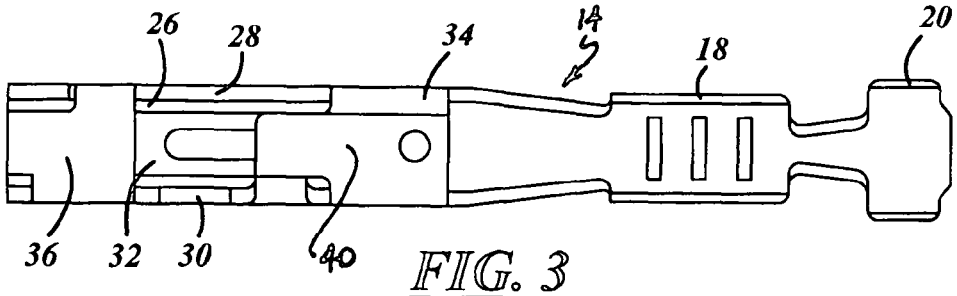
FIG. 3 is a top view of the electric terminal shown in FIG. 1.
Figure 4:
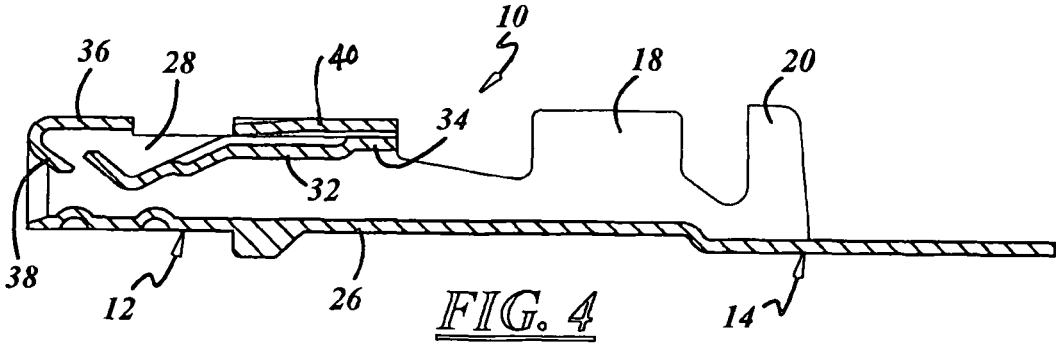
FIG. 4 is a longitudinal section of the electric terminal shown in FIG. 1.

Referring now to the drawings, FIGS. 1-4 illustrate a typical female electric terminal 10 that can be manufactured by the method that is described in connection with FIGS. 5-8. Electric terminal 10 comprises a female receptacle portion 12 for receiving a male terminal (not shown) at one end and an attachment portion 14 at an opposite end for attaching terminal 10 to an electric cable 16. Forming the attachment portion typically takes less than 10 steps.

Electric terminals such as the female electric terminal 10 are conventionally formed from a strip of metal is a series of dies that punch and form the strip in several steps usually on the order of 30-40 steps. Because of the need for a receptacle as well as a resilient contact tongue within the receptacle, the female receptacle portion 12 is much more complicated structurally than attachment portion 14 which typically merely comprises core wings 18 and insulation crimp wings 20 which are formed in barrels. The core and insulation crimp barrels are then crimped tightly around the exposed core end 22 and insulation jacket 24 of electric cable 16. Female receptacle portion 12 on the other hand, is much more complex comprising several integrally connected parts in a one-piece construction. More specifically female socket portion 12 has a floor 26 with two laterally space side walls 28 and 30 connected to opposite longitudinal side edges of the floor respectively. A contact tongue 32 extends longitudinally from a support 34 that is cantilevered in a lateral direction from a rearward portion of side wall 28.

Contact tongue 32 is disposed in a receptacle formed by floor 26, side walls 28 and 30 and top walls 36 and 40. The forward top wall 36 extends laterally from side wall 30 and the forward top wall 36 has a tongue protector 38 folded inwardly and rearwardly from a forward edge to protect the free end of the contact tongue 32 within the receptacle. The rearward top wall 40 also extends laterally from side wall 30 to cover the rearward portion of contact tongue 32. A forward portion of the rearward top wall 40 engages and stiffens the contact tongue 32.

Terminals, such as female electric terminal 10 are typically attached to various sized wires. For instance electric terminal 10 might be attached to cables ranging in size from a cable having a core size of 0.35 mm and an insulation jacket size of 0.55 mm to a larger cable having a core size of 0.75 mm and an insulation jacket size of 1.0 mm to a still larger cable having a core size of 1.0 mm and an insulation jacket size of 1.5 mm. Even though the female socket portion 12 of the terminal 10 may be the same for all of these cables, the attachment portion 14 of the terminal, that is the core wings 18 and the crimp wings 18, must be changed for each size cable in order to produce good electric and mechanical connections of the terminal 10 to the cable 16.

The terminals are typically produced from very long strips of material that are unwound from a large reel and processed through a set of forming dies with the finished terminals still being attached to a carrier strip. The finished terminals may be attached to electric cables one at a time either at the end of the forming operation or in a separate secondary operation. When the terminals are attached in a separate secondary operation, the finished terminals attached to the carrier strip are wound on a reel and eventually used in the secondary operation where the reel is unwound and fed into a machine that attaches the terminals to electric cables one at a time. In either event, the end terminal is normally attached to the electric cable before it is severed from the carrier strip. Irrespective of when the terminals are attached to the electric cables, it is often necessary to produce several variations of the basically the same terminal for attachment to electric cables of different sizes. This in turn increases tooling and inventory costs.

Our invention provides a method for manufacturing electric terminals for attachment to electric cables of different sizes that reduces tooling and inventory costs. Basically this is accomplished by manufacturing the terminals in primary and secondary operations where a relatively complex contact portion is formed to provide a generic strip of partially formed terminals. The partially formed terminals of this generic strip are then finished for a particular size cable in a secondary operation.

Referring now to FIGS. 5-8, FIG. 5 is a plan view of a partially fabricated generic strip 100 for making the electric terminals like those shown in FIGS. 1-4. The generic strip 100 starts as an imperforate metal strip 102 shown at the right end of FIG. 5. The metal strip 102 progresses through a series of dies (not shown) from right to left as indicated by the arrow 104 in FIG. 5; successive dies punching and forming the metal strip into a series of partially formed terminals until the generic strip 100 is formed with a plurality of partially formed electric terminals 106 preferably having completely formed contact portions such as the female receptacles indicated generally at 12 in FIGS. 1-4. The completely formed female receptacles being attached to a relatively wide carrier strip 110 in a spaced apart relationship as shown at the left hand end of FIG. 5. The carrier strip 108 is wide enough to provide a variety of predetermined attachment portions for the terminals 106 in a secondary operation with the partially formed terminal 106 being spaced apart a sufficient distance to accommodate the variety of predetermined attachment portions for attachment to cables of different sizes.

Figures 5, 6, 7, 8:
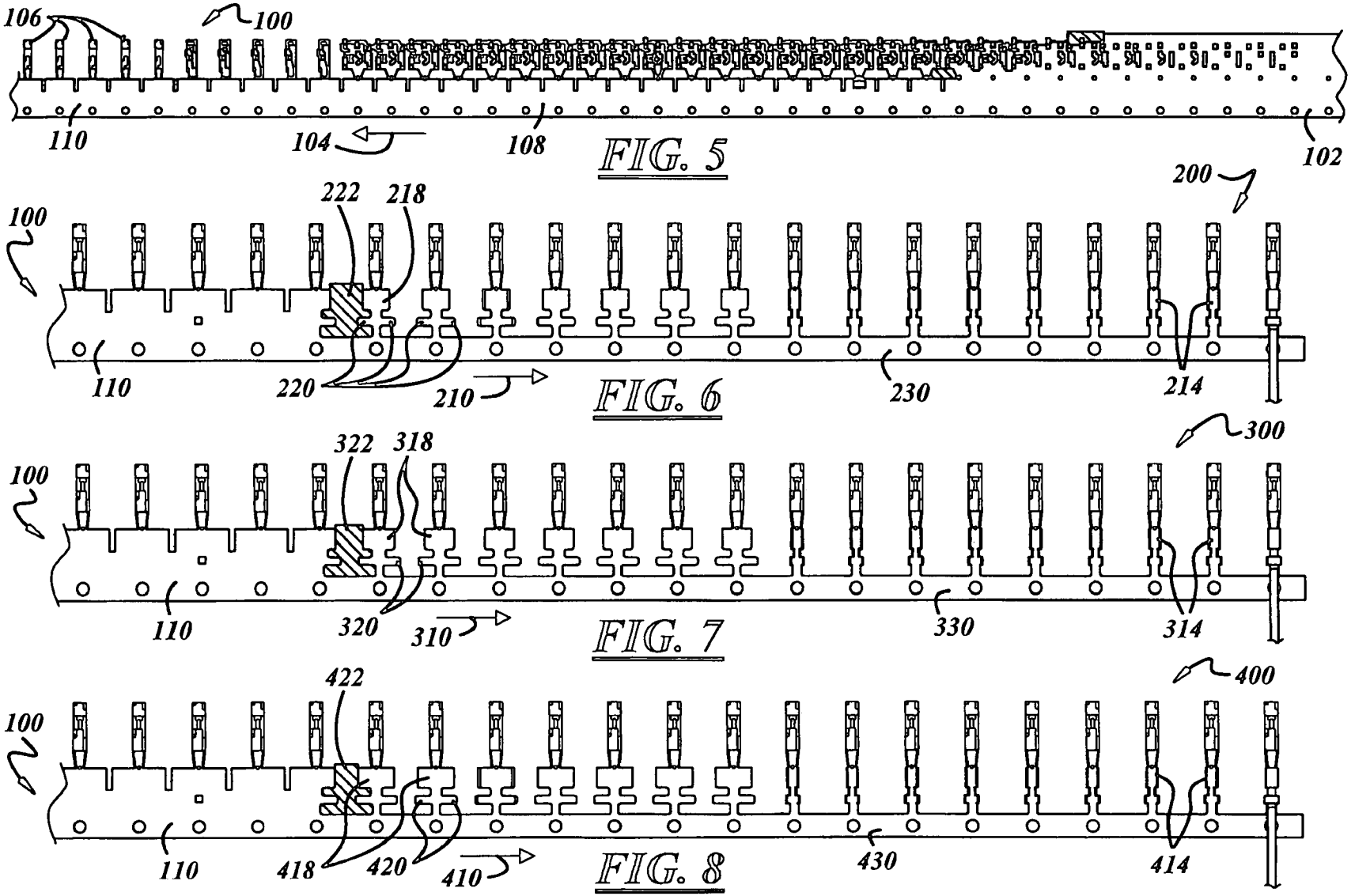
FIG. 5 is a plan view of a strip of electric terminals in various stages of manufacture in a progressive die forming operation resulting in an intermediate generic strip of partially formed terminals for manufacturing the electric terminal shown in FIGS. 1-4.
FIG. 6 is a plan view of a strip of electric terminals in various stages of manufacture in a progressive die forming operation resulting in a unique strip of completely formed terminals made from the intermediate generic strip shown in FIG. 5.
FIG. 7 is a plan view of a strip of electric terminals in various stages of manufacture in a progressive die forming operation resulting in another unique strip of completely formed terminals made from the intermediate generic strip shown in FIG. 5.
FIG. 8 is a plan view of a strip of electric terminals in various stages of manufacture in a progressive die forming operation resulting in yet another unique strip of completely formed terminals made from the intermediate generic strip shown in FIG. 5.

Briefly the generic strip 100 may be finished in a variety of ways as illustrated in FIGS. 6, 7 and 8. More specifically the generic strip 100 which is shown at the left in FIG. 6 progresses through a series of dies (not shown) from left to right as indicated by the arrow 210 in FIG. 6, successive dies punching and forming the carrier strip 110 to form the attachment portions 214, such as those indicated generally at 14 in FIGS. 1-4. These particular attachment portions 214 comprise core crimp wings 218 and insulation crimp wings 220 that are relatively narrow for attaching the terminals to a smaller cable, for instance a cable having a core size of 0.35 mm and a insulation jacket size of 0.50 mm. In the secondary operation shown in FIG. 6, a schematically illustrated stamping die 222 initially sizes a flat attachment portion while maintaining a carrier strip 230 that is considerably narrower than the starting carrier strip 110. As the process continues from left to right, the core crimp wings and the cable crimp wings are formed into open barrels and then the open core crimp barrel and the open insulation crimp barrel are crimped around the exposed end of a cable core and the end of a cable insulation in a well know manner resulting in the end terminal being attached to an electric cable as shown at the right hand end of the strip 200 shown in FIG. 6. The attached end terminal may then be severed from the carrier strip 230 in a conventional manner. Alternatively, the end terminal can be severed and then attached to the cable.

As indicated above, the generic strip blank 100 may be rolled up into a reel after completing the primary operation illustrated in FIG. 5 and then transported to a secondary operation where the reel is unwound and processed through the secondary operation. This secondary operation may result in the terminals being attached progressively to the terminal at the end of the carrier strip 230 as shown in FIG. 6 or to the terminal that is severed from the end of the carrier strip 230 as stated above. It is also possible to roll up a completed strip 200 before attaching the terminals to electric cables and do the attachment in a third operation.

Referring now to FIG. 7, the generic strip 100 may be finished in a variety of ways as stated above. Here the generic strip 100 which is shown at the left in FIG. 7 progresses through a series of dies (not shown) from left to right as indicated by the arrow 310 in FIG. 7, successive dies punching and forming the carrier strip 110 to form the attachment portions 314, such as those indicated generally at 14 in FIGS. 1-4. These particular attachment portions 314 comprise core crimp wings 318 and insulation crimp wings 320 that are wider than those shown in FIG. 6 for attaching the terminals to a larger cable, for instance a cable having a core size of 0.75 mm and an insulation jacket size of 1.0 mm. In the secondary process shown in FIG. 7, a schematically illustrated stamping die 322 that is narrower than die 222 initially sizes a flat attachment portion while maintaining a carrier strip 230 that is considerably narrower than the starting carrier strip 110. As the process continues from left to right, the core crimp wings and the cable crimp wings are formed into open barrels and then the open core crimp barrel and the open insulation crimp barrel are crimped around the exposed end of a cable core and the end of a cable insulation in a well know manner resulting in the end terminal being attached to an electric cable as shown at the right hand end of the strip in FIG. 7. The attached end terminal may then be severed from the strip 330 in a conventional manner. Alternatively, the end terminal can be severed and then attached to the cable.

As indicated above, the generic strip 100 may be rolled up into a reel after completing the primary operation illustrated in FIG. 5 and then transported to a secondary operation where the reel is unwound and processed through the secondary operation. This secondary operation may result in the terminals being attached progressively to the terminal at the end of the carrier strip 330 as shown in FIG. 7 or to the terminal that is severed from the end of the carrier strip 330 as stated above. It is also possible to roll up a completed strip 300 before attaching the terminals to electric cables and do the attachment in a third process.

Referring now to FIG. 8, the generic strip 100 may be finished in a variety of ways as stated above. Here the generic strip 100 which is shown at the left in FIG. 8 progresses through a series of dies (not shown) from left to right as indicated by the arrow 410 in FIG. 8, successive dies punching and forming the carrier strip 110 to form the attachment portions 414, such as those indicated generally at 14 in FIGS. 1-4. These particular attachment portions 414 comprise core crimp wings 418 and insulation crimp wings 420 that are still wider than those shown in FIG. 7 for attaching the terminals to an even larger cable, for instance a cable having a core size of 1.0 mm and an insulation jacket size of 1.5 mm. In the secondary process shown in FIG. 8, a schematically illustrated stamping die 422 that is even narrower than die 322 initially sizes a flat attachment portion while maintaining a carrier strip 430 that is considerably narrower than the starting carrier strip 110. As the process continues from left to right, the core crimp wings and the cable crimp wings are formed into open barrels and then the open core crimp barrel and the open insulation crimp barrel are crimped around the exposed end of a cable core and the end of a cable insulation in a well know manner resulting in the end terminal being attached to an electric cable as shown at the right hand end of the strip in FIG. 8. The attached end terminal may then be severed from the strip 430 in a conventional manner. Alternatively, the end terminal can be severed and then attached to the cable.

As indicated above, the generic strip 100 may be rolled up into a reel after completing the primary operation illustrated in FIG. 5 and then transported to a secondary operation where the reel is unwound and processed through the secondary operation. This secondary operation may result in the terminals being attached progressively to the terminal at the end of the carrier strip 430 as shown in FIG. 8 or to the terminal that is severed from the end of the carrier strip 430 as stated above. It is also possible to roll up a completed strip 400 before attaching the terminals to electric cables and do the attachment in a third process Thus it can be seen that the method of the invention provides for attaching female terminals to a variety of different sized electric cables thus avoiding high inventory costs.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A method of manufacturing a series of electric terminals where each terminal in the series of electric terminals has a contact portion and an attachment portion opposite the contact portion, that attachment portion being configured for attachment to a wire cable, the method comprising:

forming the contact portion for each terminal in the series of electric terminals from a metal strip in a first progressive die forming operation to produce a generic strip of partially formed terminals;

forming the attachment portion for at least one terminal in the series of electric terminals in a second progressive die forming operation to produce a strip of completely formed terminals from the generic strip of partially formed terminals; and wherein the step of forming the attachment portion further includes configuring the attachment portion in the strip of completely formed terminals to fit different sized wire cables.

2. The method of claim 1, wherein the attachment portions are configured to have different lateral widths, the lateral widths being generally perpendicular to a length of the terminal, and the attachment portion of the at least one terminal disposed in the strip of completely formed terminals comprises at least one core wing and at least one insulation core wing.

3. The method of claim 1, wherein the contact portion of each terminal in the generic strip of partially formed terminals comprises a female receptacle portion, and the female receptacle portion includes, a support, a floor having two laterally spaced side walls extending from the floor and connected to respective opposite longitudinal side edges of the floor, a contact tongue extending longitudinally from the support being cantilevered in a lateral direction from a rearward portion of at least one of the laterally spaced side walls, and a top wall extending laterally from at least one of the side walls.

4. The method of claim 1, further including, attaching the wire conductor to each of the at least one terminal in the strip of completely formed terminals in a manufacturing operation different from said first operation and said second operation.

* * * * *